US007130533B2

(12) United States Patent
Kim et al.

(10) Patent No.: US 7,130,533 B2
(45) Date of Patent: Oct. 31, 2006

(54) WATER HEATING APPARATUS AND REFRIGERATOR HAVING THE SAME

(75) Inventors: Seong Jae Kim, Ansan-si (KR); Myung Ryul Lee, Sungnam-si (KR); Ill Shin Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 209 days.

(21) Appl. No.: 10/465,617

(22) Filed: Jun. 20, 2003

(65) Prior Publication Data

US 2004/0202457 A1 Oct. 14, 2004

(30) Foreign Application Priority Data

Apr. 8, 2003 (KR) ..... 10-2003-0021949

(51) Int. Cl.
*F24H 7/02* (2006.01)

(52) U.S. Cl. ..... 392/341; 392/465; 62/440

(58) Field of Classification Search ..... 392/341, 392/441, 449, 465, 466; 62/440
See application file for complete search history.

(56) References Cited

U.S. PATENT DOCUMENTS

| | | | | |
|---|---|---|---|---|
| 1,595,819 A | | 8/1926 | Bluemin | |
| 2,987,605 A | | 6/1961 | Brandl | |
| 4,602,145 A | * | 7/1986 | Roberts | 392/496 |
| 4,786,782 A | | 11/1988 | Takai et al. | |
| 5,271,086 A | | 12/1993 | Kamiyama et al. | |
| 5,590,240 A | | 12/1996 | Rezabek | |
| 5,715,569 A | * | 2/1998 | Dickey | 15/415.1 |
| 5,956,967 A | | 9/1999 | Kim | |
| 6,173,118 B1 | * | 1/2001 | Harris | 392/451 |
| 6,577,817 B1 | * | 6/2003 | Harris | 392/481 |

FOREIGN PATENT DOCUMENTS

| | | | |
|---|---|---|---|
| FR | 794940 | | 2/1936 |
| FR | 2588360 | | 4/1987 |
| GB | 2035764 | * | 6/1980 |
| GB | 1574406 | | 9/1980 |
| JP | 57-136081 | | 8/1982 |
| JP | 58-173387 | | 10/1983 |
| JP | 61-252467 | | 11/1986 |
| JP | 9-004958 | | 1/1997 |
| JP | 9-243173 | | 9/1997 |
| JP | 2000-304432 | | 11/2000 |
| KR | 0119072 | | 12/1993 |
| KR | 98-083727 | | 12/1998 |
| KR | 10-0199980 | | 12/1998 |
| KR | 2001008272 | * | 2/2001 |
| WO | 2004/092664 | | 10/2004 |

OTHER PUBLICATIONS

English language Abstract of FR2588360.

English Language Abstract of JP 58–173387.

"Heater for Liquids with Reduced Potential for Precipitate Formation", Research Disclosure, Kenneth Mason Publications, No. 305, Sep. 1, 1989, pp. 652.

English language Abstract of KR 0119072.

English Language Abstract of KR 10–0199980.

English Language Abstract of JP2000–304432.

English Language Abstract of JP 9–243173.

English Language Abstract of JP 9–004958.

* cited by examiner

*Primary Examiner*—Thor S. Campbell
(74) *Attorney, Agent, or Firm*—Greenblum & Bernstein, P.L.C.

(57) ABSTRACT

The present invention relates to a water heating apparatus having a heat exchanger that has a maximized heat transfer area between a hot water supply tube and a heater so that clean hot water is continuously fed without a time delay. To achieve these objects, a water heating apparatus comprises: a case defining a body; a hot water supply tube having an heat exchanger installed in the case; a heat storage liquid material received in the case; and a heater installed in the case, for heating the heat storage liquid material.

6 Claims, 2 Drawing Sheets

WATER HEATING APPARATUS AND REFRIGERATOR HAVING THE SAME

This application claims the benefit of the Korean Application No. P2003-0021949 filed on Apr. 8, 2003, which is hereby incorporated by reference.

BACKGROUND OF THE INVENTION

1. Field of the Invention

The present invention relates to a water heating apparatus, and more particularly, to a water heating apparatus having a hot water supply tube provided with a heat exchanger having a maximized heat transfer area and a refrigerator having the same.

2. Description of the Related Art

Hot water may be obtained from a conventional refrigerator. A method of generating hot water from the conventional refrigerator is disclosed in Korea utility model laid open publication No. 119072 (Mar. 12, 1998). In the above prior art, drinking water fed externally is heated by heat emitted from a condenser, stored in a hot storage tank and taken when necessary.

As anther method of generating hot water, there is Korea Patent laid open publication No. 199980 (Mar. 8, 1999). In the above method, heater is installed outside water supply tube, and drinking water is heated by heater, stored in a hot storage tank and taken when necessary.

However, since the refrigerators according to the related arts store hot water in hot water storage tank and then use it, it has various disadvantages in that its use is very inconvenient, sanitation is poor and maintenance and repair are difficult.

In other words, once hot water stored in the hot water storage tank is taken in excess of a predetermined amount, water is again heated to generate hot water. This is inconvenient since users have to wait for a long time until the generated hot water is stored in the hot water storage tank.

If the users use the refrigerator for a long term period, foreign material is deposited on the hot water storage tank and thus the hot water stored in the hot water storage tank is spoiled to deteriorate sanitation. To this end, it is necessary to clean up the hot water storage tank periodically to get rid of the foreign material deposited on the hot water storage tank, which provides a difficulty to maintain and repair the refrigerator.

Also, an auxiliary heat source is needed additionally so as to generate hot water due to limitations in heat capacitance and heat transfer area of condenser or heater.

SUMMARY OF THE INVENTION

Accordingly, the present invention is directed to a water heating apparatus and a refrigerator having the same that substantially obviate one or more problems due to limitations and disadvantages of the related art.

An object of the present invention is to provide a water heating apparatus in which hot water is fed without a time delay by installing a heat exchanger at a hot supply tube; the heat exchanger having a maximized heat transfer area in heat exchange from and to a heater.

Another object of the present invention is to provide a water heating apparatus in which hot water generated in a hot water supply tube is taken such that foreign material is not deposited, thereby improving sanitation and making easy maintenance and repair.

A further object of the present invention is to provide a water heating apparatus in which hot water is generated through a heat exchanger having a maximized heat transfer area in heat exchange from and to heater and thereby an auxiliary heat source is not installed additionally.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a water heating apparatus comprises: a case defining a body; a hot water supply tube having an heat exchanger installed in the case; a heat storage liquid material received in the case; and a heater installed in the case, for heating the heat storage liquid material.

The heat exchanger has a shape to maximize a heat transfer area and is comprised of a wound wire.

Preferably, the wound wire of the heat exchanger has a spiral shape, and is comprised of a plurality of turns spaced apart by an interval from each other.

It is further preferable that the heat storage liquid material is material having a high specific heat such as water or paraffin.

The case is illustrated and described to have a cylindrical shape in this specification but is not limited by the shape. The size and shape of the case depend on the space structure in which the case is installed, the longitudinal length of the heat exchanger and the winding shape of the wound wire.

Preferably, the case has an inner surface coated with ceramic so as to prevent corrosion and improve heat resistant property and an outer surface covered with adiabatic material such as glass fiber or synthetic resin so as to prevent heat from emitting to exterior.

The hot water supply tube is further desirably comprised of a copper tube or a stainless tube to enhance corrosion prevention and heat conductivity from the heater.

The heater is installed in a longitudinal direction of the heat exchanger in the case.

The heater is preferably installed in a space defined between a center axis of the case and the heat exchanger, and it is further preferable that the heater is a seizing heater.

The water heating apparatus further comprises a temperature sensor installed in the case, for sensing temperature of the heat storage liquid material; and a microcomputer for turning the heater on/off depending on the temperature sensed by the temperature sensor.

In another aspect of the present invention, a refrigerator comprises: a body defining an outer shell; a water supply tube installed in the body to connect to external water pipe; a hot water supply tube branched from the water supply tube and having an heat exchanger at a predetermined portion; a cold water supply tube branched from the water supply tube; a case installed to surround a heat exchanger of the hot water supply tube; a heat storage liquid material received in the case; and a heater installed in the case, for heating the heat storage liquid material.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and, are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
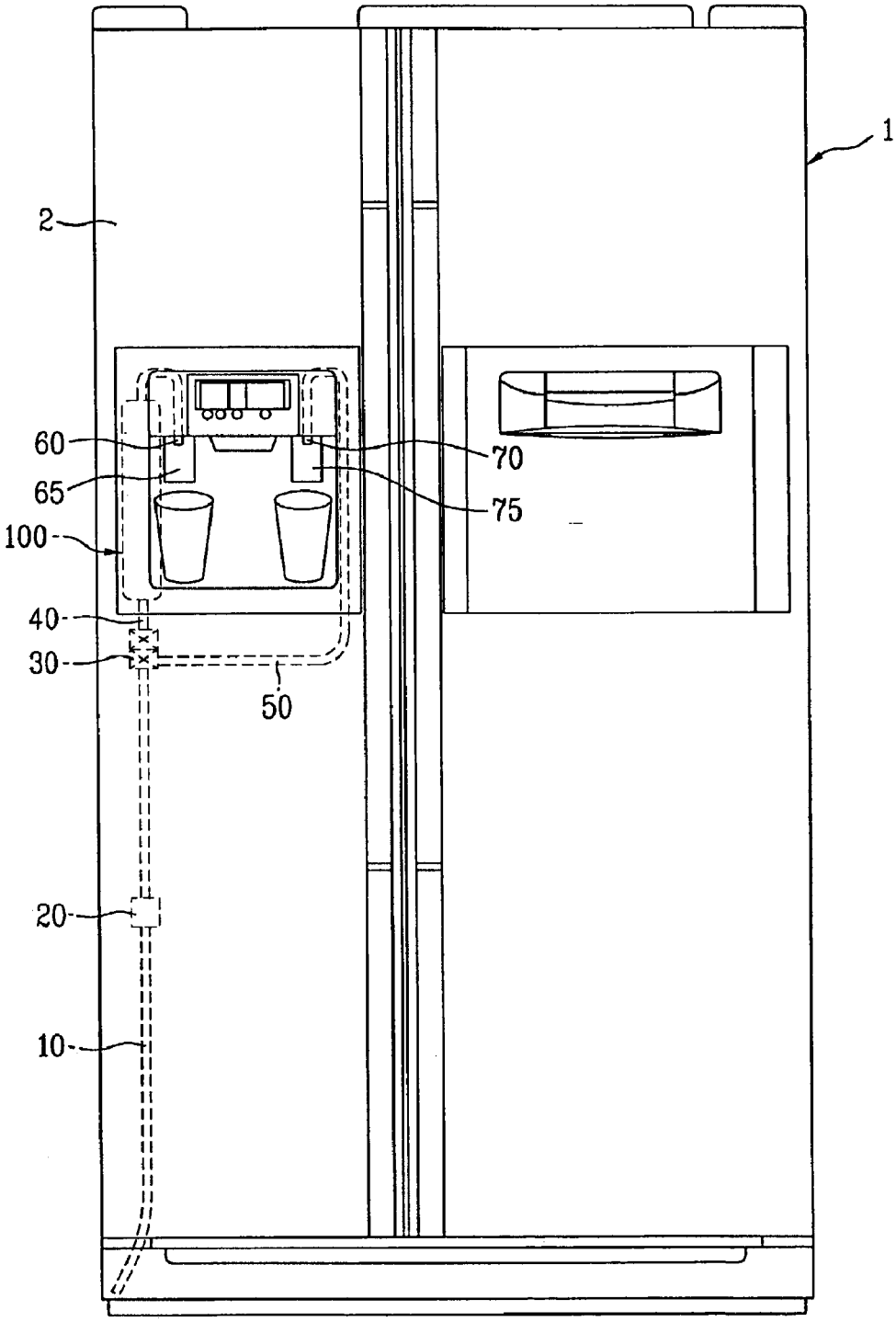
FIG. 1 is a schematic view illustrating a refrigerator that has a water heating apparatus according to an embodiment of the present invention.

As shown in FIG. 1, a refrigerator having a water heating apparatus according to an embodiment of the present invention, includes a body 1 defining an outer shell, a door 2 formed in the front of the body 1, a water supply tube 10 installed in the body 1 so as to be connected with an external water pipe (not shown), a hot water supply tube 40 branched from the water supply tube 10 and having a heat exchanger at a predetermined portion, a cold water supply tube 50 branched from the water supply tube 10.

A filter 20 for filtering the water fed from an exterior and removing foreign material from the water is installed on the water supply tube 10. Three-way valve 30 for controlling the water flow direction is installed on a branch portion of the water supply tube 10, which is branched from the water supply tube 10 to the hot water supply tube 40 and the cold water supply tube 50.

A hot water supply unit 60 for supplying hot water depending on operation of a hot water supply control lever 65 is installed at an end of the hot water supply tube 40. A cold water supply unit 70 for supplying hot water depending on operation of a cold water supply control lever 75 is installed at an end of the cold water supply tube 50.

Figure 2:
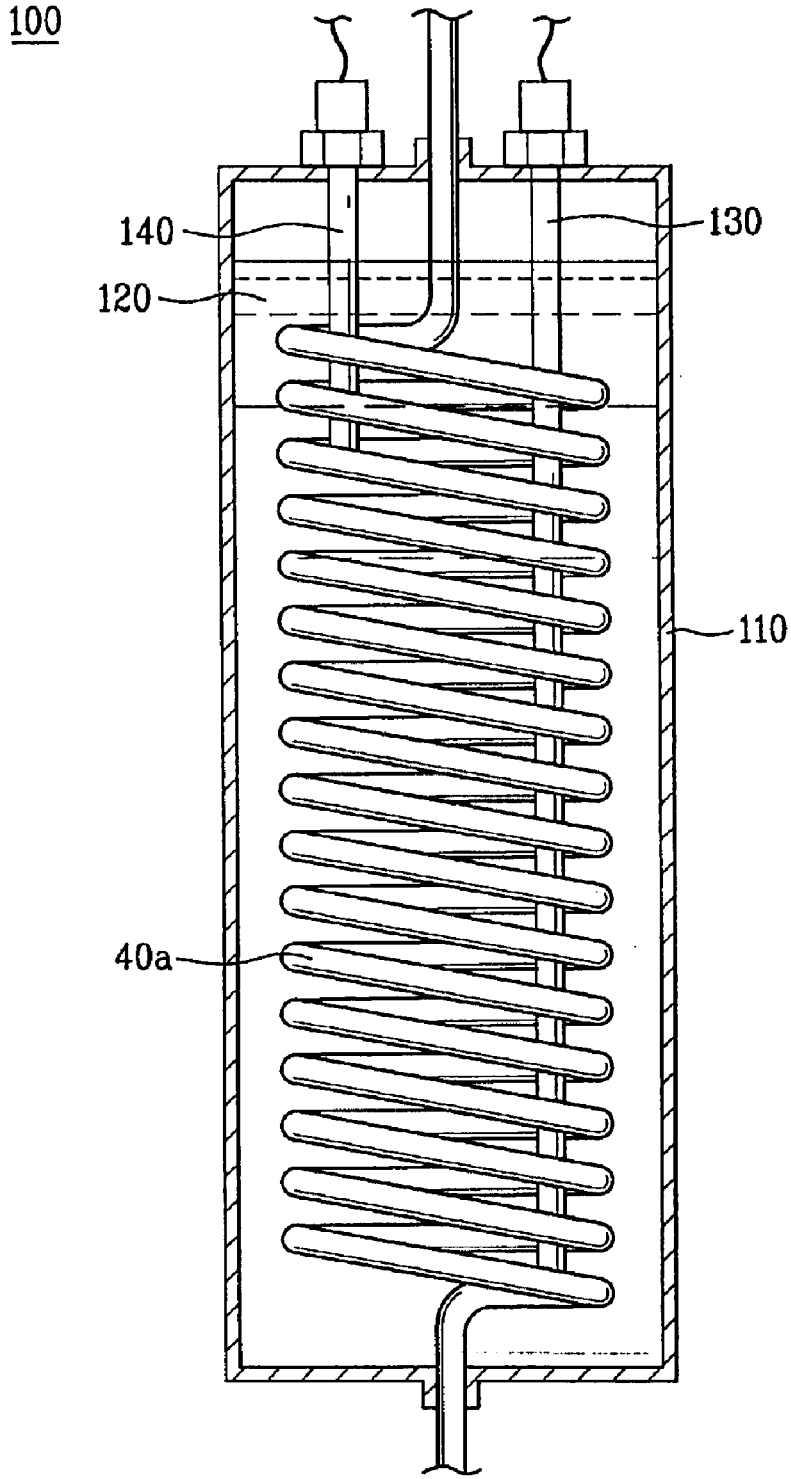
FIG. 2 is a schematic view illustrating a water heating apparatus according to an embodiment of the present invention.

Meanwhile, as shown in FIG. 2, a water heating apparatus 100 is arranged on the hot water supply tube 40. The hot water heating apparatus 100 includes a heat exchanger 40*a* provided with a wire wound on a portion of the hot water supply tube 40 to maximize heat transfer area, a case 110 installed to surround a heat exchanger 40*a* of the hot water supply tube, a heat storage liquid material 120 received in the case 110, and a heater 130 installed in the case 110, for heating the heat storage liquid material 120.

A temperature sensor 140 for sensing temperature of the heat storage liquid material 120 is installed in the case 110. A microcomputer (not shown) for turning the heater 130 on/off depending on the temperature sensed by the temperature sensor 140 is installed in the refrigerator body 1 to control the temperature of the heat storage liquid material 120 more easily.

In the meanwhile, it is desirable that the wound wire of the heat exchanger 40*a* has a spiral shape and the turns of the wire are spaced apart from each other.

It is further desirable that the heat storage liquid material 120 is of material having a high specific heat such as water or paraffin.

The case 110 is illustrated and described to have a hollow cylindrical shape in this specification but is not limited only to the shape. The size and shape of the case 110 depend on the space structure of the refrigerator body 1, the longitudinal length of the heat exchanger 40*a* and the winding shape of the wound wire.

Preferably, an inner surface of the case 110 is coated with ceramic to prevent corrosion and improve heat resistant property and an outer surface of the case 110 is covered with adiabatic material such as glass fiber or synthetic resin to prevent heat from emitting to exterior.

Further, the hot water supply tube 40 is preferably of a copper tube or a stainless tube to prevent corrosion and enhance heat conductivity from the heater 130.

The heater 130 is installed in the case 110, particularly, in a space formed in the heat exchanger 40*a* in a longitudinal direction. More preferably, the heater 130 is a sheath heater.

The hot water supply process of the refrigerator that has a water heating apparatus 100 according to an embodiment of the present invention configured as described above will be described now.

In a hot water standby state, drinking water is fed from an external water supply pipe to the water supply tube 10, filtered through the filter 20 to get rid of foreign material, and fed to the hot water supply tube 40 through the three-way valve 30.

Microcomputer controls the heater 130 to heat the heat storage liquid material 120, and the heated heat storage liquid material 120 heats the heat exchanger 40*a*.

At this time, the water fed to the hot water supply tube 40 is rapidly heated while passing through the heat exchanger 40*a*.

The temperature sensor 140 senses the temperature of the heat storage liquid material 120 continuously. At this time, the microcomputer compares actual temperature and set temperature of the heat storage liquid material 120.

If the actual temperature of the heat storage liquid material 120 is higher than the set temperature, the microcomputer turns the heater 130 off. If the actual temperature of the heat storage liquid material 120 is lower than the set temperature, the microcomputer turns the heater 130 on. The microcomputer repeats the above-mentioned process to maintain the temperature of the hot water stored in the heat exchanger 40*a* to be constant.

Next, the actual supply process of the hot water generated as described above will be described.

As described above, in the hot water standby state, if a user operates the hot water supply operation lever 65 of the hot water supply unit 60 provided in the front of the refrigerator door 2, the hot water stored in the heat exchanger 40*a* is fed to the user through the hot water supply unit 60 without a delay.

The drinking water additionally fed to the hot water supply tube 40 by an amount of hot water fed to the user through the hot water supply tube 40 is rapidly heated while passing through the heat exchanger 40*a* so that the user can get the desirable amount of the hot water.

In other words, the heat exchanger 40*a* whose heat transfer area is maximized is formed on the hot water supply unit 40 so that the water passing through the heat exchanger 40*a* is rapidly heated owing to heat exchange with the heat storage liquid material 120 and fed to the user.

On the other hand, the heater 130 is turned on/off with a predetermined interval without installing the temperature sensor 140 to generate hot water and supply it to the user.

In other words, hot water can be fed to the user by repeating steps of turning the heater 130 on for a predetermined time to heat the heat exchanger 40*a* through the heat storage liquid material 120 and generate hot water and then turning the heater 130 off for a predetermined time.

Here, the on/off time of the heater 130 can be adjusted to efficiently generate hot water and supply it to the user.

Additionally, in a feed of cold water, drinking water is fed even to the cold water supply tube 50 and is cooled while passing through the cold water supply tube 50 branched to an evaporator (not shown). So, the cooled water is received in the cold water supply tube 50.

Accordingly, if the user operates the cold supply operation lever 75 of the cold water supply unit 70 provided in the front of the refrigerator door 2, the cold water received in the cold supply tube 50 is rapidly fed to the user through the cold supply unit 70.

The additional water fed to the cold supply tube 50 as much as the amount of the fed water is cooled while passing the cold water supply tube 50 branched to an evaporator. So, the user can take the cold water as he or she wants.

As a result, the fed water is rapidly heated using the water heating apparatus including the heat exchanger having the maximized heat transfer area with the heater on the hot water supply tube so that the user can take the hot water as he or she wants.

Since hot water can be generated and fed without installing any additional storage tank, foreign material is not deposited and the water is not spoiled.

Thus, since clean water is fed to the user, the sanitation is improved. It is easy to manage them since the user does not have to get rid of the foreign material.

Since hot water is generated by the heat exchanger that has the maximized heat transfer area with the heater, hot water can be fed without installing any additional auxiliary heat source.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A refrigerator comprising:

a body defining an outer shell and having a door;

a water supply tube connected to an external water source and configured to be extended to an inside of the door through the body;

a hot water supply tube that branches from the water supply tube;

a cold water supply tube that branches from the water supply tube;

a three-way valve in the water supply tube at a branching point to the hot water supply tube and to the cold water supply tube, and that controls a water flow direction;

a case positioned about the heat exchanger of the hot water supply tube;

a heat storage liquid material in the case;

a heater in the case, that heats the heat storage liquid material;

a hot water supply unit provided at the door and connected to the hot water supply tube; and a cold water supply unit provided at the door and connected to the cold water supply tube.

2. The refrigerator of claim 1, wherein the heat exchanger comprises a plurality of turns spaced from each other by a predetermined interval, and the bar-shaped heater in the heat exchanger extends in a longitudinal direction of the heat exchanger through substantially the entire length of the heat exchanger.

3. A refrigerator comprising:

a body defining an outer shell and having a door;

a water supply tube connected to an external water source and configured to be extended to an inside of the door through the body;

a hot water supply tube that branches from the water supply tube and that has a heat exchanger at a predetermined portion;

a cold water supply tube that branches from the water supply tube;

a case provided about the heat exchanger of the hot water supply tube;

a heat storage liquid material in the case;

a heater in the case, that heats the heat storage liquid material;

a hot water supply unit provided at the door and connected to the hot water supply tube;

a cold water supply unit provided at the door and connected to the cold water supply tube; and a filter provided on the water supply tube in the door, that filters water running through the water supply tube.

4. The refrigerator of claim 3, wherein the heat exchanger comprises a plurality of turns spaced from each other by a predetermined interval, and the bar-shaped heater in the heat exchanger extends in a longitudinal direction of the heat exchanger through substantially the entire length of the heat exchanger.

5. A refrigerator comprising:

a body defining an outer shell and having a door;

a water supply tube connected to an external water source and configured to be extended to an inside of the door through the body;

a hot water supply tube that branches from the water supply tube and that has a heat exchanger at a predetermined portion;

a cold water supply tube that branches from the water supply tube;

a three-way valve is the water supply tube at a branching point to the hot water supply tube and to the cold water supply tube, and that controls a water flow direction;

a case provided about the heat exchanger of the hot water supply tube;

a heat storage liquid material in the case;

a heater in the case, that heats the heat storage liquid material;

a hot water supply unit provided at the door and connected to the hot water supply tube;

a cold water supply unit provided at the door and connected to the hot water supply tube; and a filter provided on the water supply tube in the door, that filters water running through the water supply tube.

6. The refrigerator of claim 5, wherein the heat exchanger comprises a plurality of turns spaced from each other by a predetermined interval, and the bar-shaped heater in the heat exchanger extends in a longitudinal direction of the heat exchanger through substantially the entire length of the heat exchanger.

* * * * *